US005548874A

United States Patent [19]

Mishina et al.

[11] Patent Number: 5,548,874

[45] Date of Patent: Aug. 27, 1996

[54] TONGUE ASSEMBLY FOR SEAT BELT DEVICE

[75] Inventors: Jyoji Mishina; Masahiro Tanabe, both of Shiga, Japan

[73] Assignee: Takata Corporation, Tokyo, Japan

[21] Appl. No.: 432,696

[22] Filed: May 2, 1995

[30] Foreign Application Priority Data

May 10, 1994 [JP] Japan ..... 6-096249

[51] Int. Cl.[6] ..... A44B 11/00

[52] U.S. Cl. ..... 24/170; 24/191

[58] Field of Search ..... 24/170, 173, 188, 24/196, 191, 585, 68 CD; 297/476, 481; 280/801.1

[56] References Cited

U.S. PATENT DOCUMENTS

| | | | |
|---|---|---|---|
| 2,618,827 | 11/1952 | Hora | 24/170 |
| 4,480,854 | 11/1984 | Doty . | |
| 4,588,207 | 5/1986 | Doty . | |
| 4,727,628 | 3/1988 | Rudholm | 24/170 |
| 4,871,190 | 10/1989 | Willey | 280/801.1 |
| 4,903,377 | 2/1990 | Doty . | |
| 5,058,244 | 10/1991 | Fernandez | 24/170 |
| 5,222,278 | 6/1993 | Ball et al. . | |
| 5,243,740 | 9/1993 | Wakabayashi | 24/170 |

FOREIGN PATENT DOCUMENTS 2-35012 9/1990 Japan .

*Primary Examiner*—Victor N. Sakran
*Attorney, Agent, or Firm*—Kanesaka & Takeuchi

[57] ABSTRACT

A tongue assembly for a seat belt device has a tongue body formed in a plate shape having a first slit through which a belt webbing extends, and a locking plate having a second slit through which the belt webbing extends. The tongue body has a front end portion thereof as an insertion portion to be inserted into a buckle. The first slit is formed in a rear portion of the tongue body and extends in the lateral direction perpendicular to the longitudinal direction of the tongue body. The locking plate is disposed to face a surface of the tongue body rearwardly away from the first slit, further extends rearwardly away from a rear edge of the tongue body, and has a front end supported to the tongue body to allow pivotal movement of the locking plate in a direction that a rear end portion thereof freely leaves from or approaches the tongue body. The second slit is formed in a rear portion of the locking plate and extends in the lateral direction. The locking plate is provided with a cutout connecting the second slit with the rear edge of the locking plate.

9 Claims, 11 Drawing Sheets

TONGUE ASSEMBLY FOR SEAT BELT DEVICE

FIELD OF THE INVENTION AND RELATED ART STATEMENT

The present invention relates to a tongue assembly for use in a seat belt device, more particularly to a tongue assembly which is suitable for fixing a child restraining seat on a vehicle seat.

In general, a seat belt device is, as well known, mounted in a vehicle to protect an occupant by restraining him or her when the vehicle comes into collision.

A seat belt device of Japanese Utility Model Publication No. H2-35012 is a three-point continuous loop seat belt device wherein, as shown in FIG. 9, a belt webbing 10 extends through a tongue 12, one end of the belt webbing 10 is anchored to a vehicle body and the opposite end of the belt webbing 10 is wound on a seat belt retractor (not shown). The tongue 12 is designed to be inserted into a buckle 14 installed to a vehicle body.

The three-point continuous loop seat belt device is used for holding a child restraining seat (a complete set of a chair for an infant) 18, put on a vehicle seat 16, in position on the vehicle seat 16 as shown in FIG. 9. Reference numeral 10A denotes a lap belt which extends from one end thereof to the tongue 12, and the child restraining seat 18 is fastened by the lap belt 10A. A numeral 10B designates a shoulder belt which extends from the tongue 12 to the retractor.

In such a structure for holding the child restraining seat, it is necessary that the lap belt 10A securely keeps restraining movement of the child restraining seat 18 on the vehicle seat 16 even when the shoulder belt 10B is loose.

In Japanese Utility Model Publication No. H2-35012, as shown in FIG. 9, the lap and shoulder belts 10A and 10B are overlapped together at a position about the tongue 12 by a clip so that the tension on the lap belt 10A is kept tightly because of friction between the lap belt 10A and the shoulder belt 10B.

A tongue assembly, which prevents looseness of the belt webbing by friction between a lap belt and a shoulder belt and friction between the belts and a tongue, is described in U.S. Pat. No. 5,222,278 (as particularly seen in FIG. 5 of the patent).

U.S. Pat. No. 4,480,854, U.S. Pat. No. 4,588,207, and U.S. Pat. No. 4,903,377 disclose a tongue assembly which is capable of keeping the tension on a lap belt 10A. As shown in FIG. 7 and FIG. 8, such a tongue assembly has a structure wherein a tongue body 20 is fitted in a slider 22 and the slider 22 is urged rearwardly of the tongue by the tensile force on the belt webbing 10 so that the belt webbing 10 is clamped between a wall 24 disposed on the tongue body 20 and a rear edge 26 of the slider 22.

OBJECT AND SUMMARY OF THE INVENTION

In the aforementioned structure, it is not easy to keep the lap belt 10A to provide enough tension.

It is therefore an object of the present invention to provide a tongue assembly which is possible to keep a lap belt to provide enough tension.

A tongue assembly for a seat belt device according to the present invention comprises a tongue body formed in a plate shape having a front end portion thereof as an insertion portion to be inserted into a buckle. A first slit through which a belt webbing passes is formed in a rear portion of the tongue body. The first slit extends in the lateral direction vertical to the longitudinal direction of the tongue body. A locking plate is disposed to face a surface of the tongue body positioned rearwardly than the first slit and extends beyond the rear edge of the tongue body. The locking plate has a front end supported to the tongue body to allow pivotal movement of the locking plate in a direction that a rear end portion thereof freely leaves from or approaches the tongue body. A second slit through which the belt webbing passes is formed in a rear portion of the locking plate to extend in the lateral direction of the locking plate.

It is preferable that the locking plate is also provided with a cutout connecting the second slit with the rear edge of the locking plate.

When the child restraining seat is fixed with the tongue assembly for a seat belt device according to the present invention, the belt webbing passes the second slit of the locking plate and the first slit via a path between the locking plate and the tongue body. The belt webbing is turned back to the rear side of the tongue body and is then drawn out through the second slit. The drawn out portion of the belt webbing is a lap belt.

In the tongue assembly as structured above, as the belt webbing is in tension, the locking plate is pushed against the tongue body by the tension so that the belt webbing is clamped between the locking plate and the tongue body.

The second slit is positioned near a rear edge of the locking plate and the clamping portion between the locking plate and the tongue body is thus positioned between the second slit and a front edge of the locking plate. The locking plate acts like a lever to be strongly pushed by the webbing against the tongue body, whereby the belt webbing is strongly clamped between the locking plate and the tongue body.

Once the belt webbing fastens the child restraining seat, the belt webbing is kept being clamped between the locking plate and the tongue body because the locking plate is always pushed against the tongue body by the tension on the lap belt.

Therefore, the extremely strong tension on the lap belt remains even when the shoulder belt becomes loose to lose tension thereof. That is, the lap belt can keep holding strongly the child restraining seat even when the shoulder belt is loose.

DETAILED DESCRIPTION OF PREFERRED EMBODIMENTS

Figure 1:
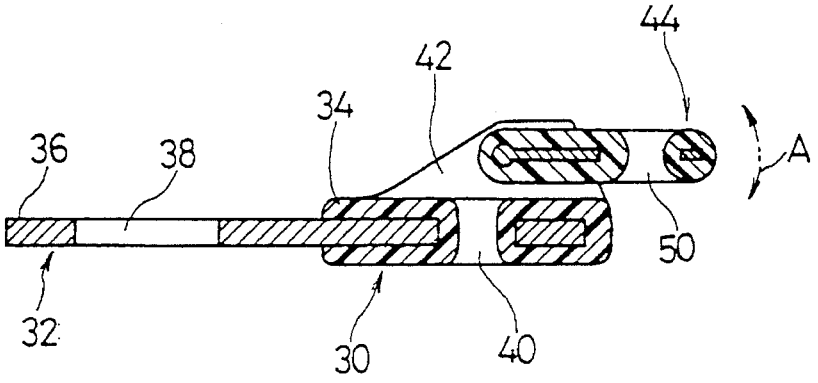
FIG. 1 is a longitudinal sectional view of a tongue assembly according to a first embodiment of the present invention.
Figure 2:
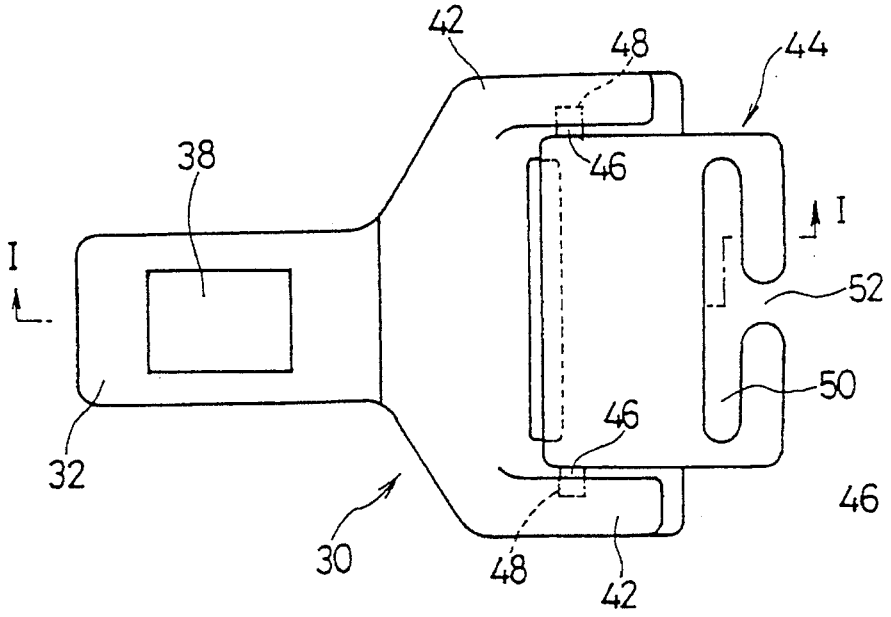
FIG. 2 is a top plan view of the tongue assembly according to the first embodiment.
Figure 3:
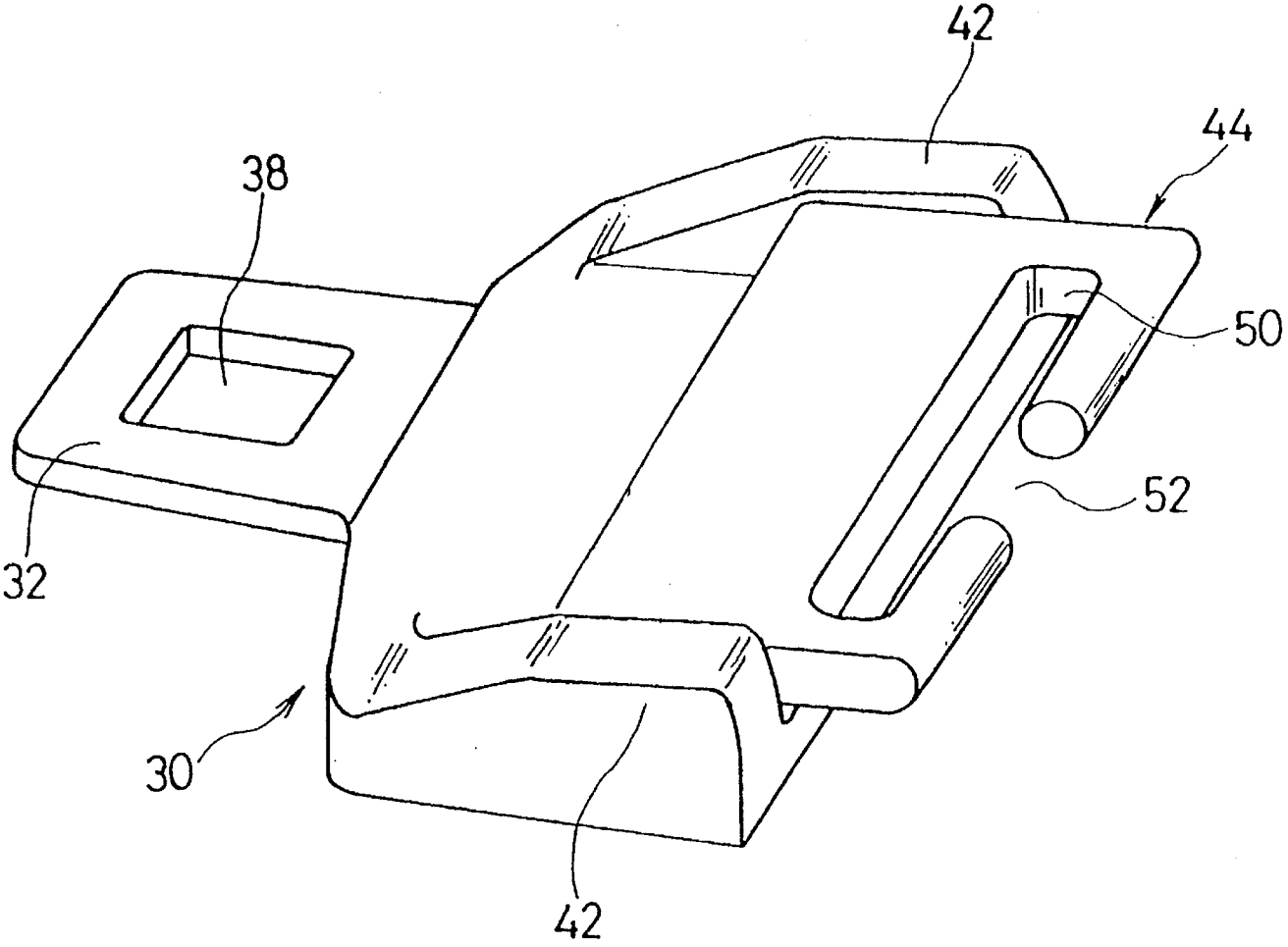
FIG. 3 is a perspective view of the tongue assembly according to the first embodiment.
Figure 4:
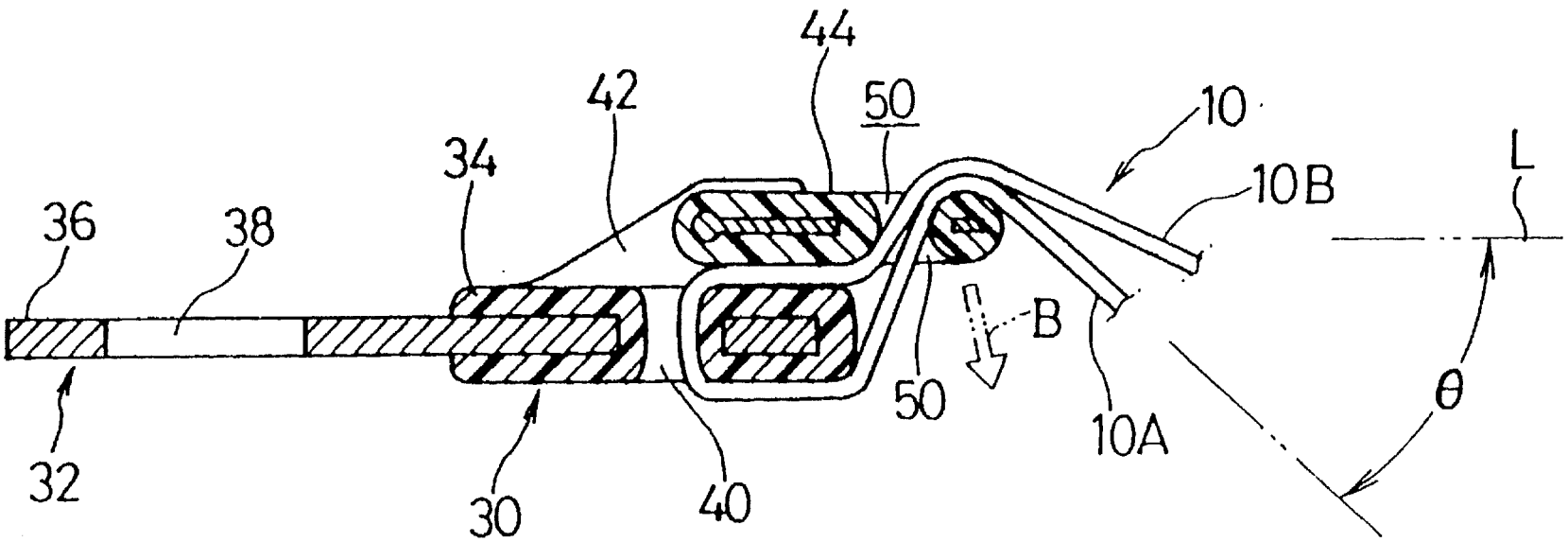
FIG. 4 is a sectional view of the tongue assembly of the first embodiment, with belt webbing extending therethrough.
Figure 5:
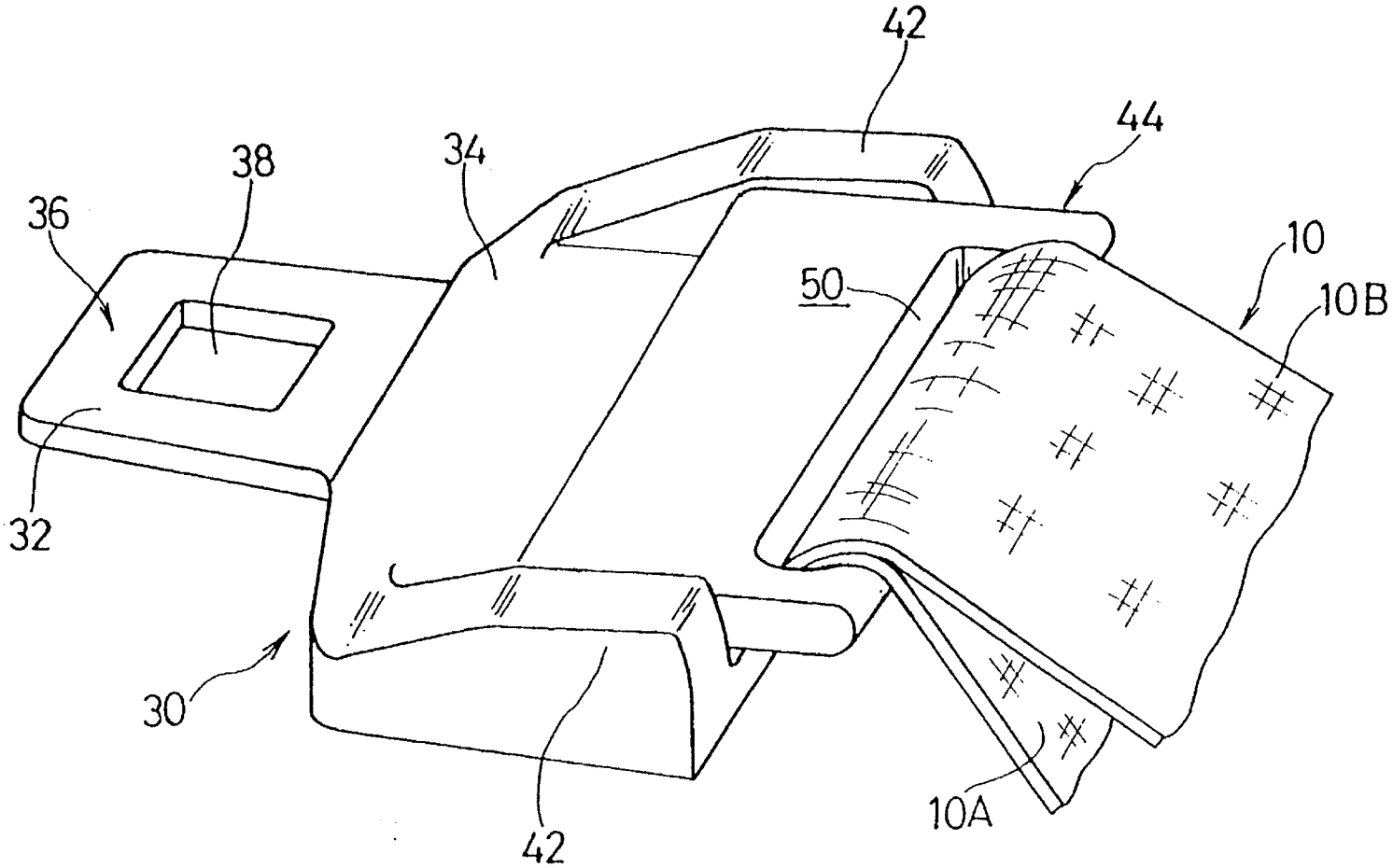
FIG. 5 is a perspective view of the tongue assembly of the first embodiment, with the belt webbing extending therethrough.

Hereinafter, embodiments will be described referring to the drawings. FIG. 1 is a longitudinal sectional view showing a tongue assembly according to a first embodiment of the present invention, FIG. 2 is a top plan view showing the tongue assembly, FIG. 3 is a perspective view showing the tongue assembly, FIG. 4 is a longitudinal sectional view showing the tongue assembly with belt webbing extending therethrough for holding a child restraining seat, and FIG. 5 is a perspective view showing the same as shown in FIG. 4.

A numeral 30 designates a tongue body formed in a plate shape. The tongue body 30 comprises a metal plate 32 and a synthetic resin member 34 stuck to the metal plate 32. The synthetic resin member 34 is molded as a unitary piece on the metal plate 32 by setting the metal plate 32 as an insert in a mold for the synthetic resin member 34 during molding the synthetic resin member 34.

The front end portion of the metal plate 32 is an insertion portion 36 to be inserted into a buckle (not shown). The insertion portion 36 is provided with an opening 38 for engaging with a latch plate of the buckle.

A first slit 40 extending laterally (in a direction vertical to the longitudinal direction of the tongue body 30) is formed in the rear end portion of the tongue body 30. The tongue body 30 has side walls 42 formed along the both side edges thereof.

A locking plate 44 is disposed to face a top surface of the tongue body 30. The locking plate 44 has pins 46 disposed on the sides near the front edges thereof and fitted into concave portions 48 disposed on the side walls 42. Therefore, the locking plate 44 is mounted to the tongue body 30 to allow pivotal movement along a direction indicated by an arrow A in FIG. 1 so that the rear end portion thereof freely leaves from or approaches the tongue body 30.

The locking plate 44 is provided with a second slit 50 extending laterally which is disposed in a rear end portion thereof. The locking plate 44 is also provided with a cutout 52 extending from the rear edge of the locking plate 44 to the second slit 50.

A rear portion of the locking plate 44 further extends rearwardly than the position of the rear edge of the tongue body 30. Therefore, the second slit 50 is disposed at a rearward position than the rear edge of the tongue body 30.

For restraining movement of the child restraining seat by using the tongue assembly as structured above, as shown in FIG. 4, a shoulder belt 10B of the belt webbing 10 passes the second slit 50 and the first slit 40 via a path between the locking plate 44 and the tongue body 30. The belt webbing 10 is then turned back at the rear edge of the tongue body 30 to reach the second slit 50. A portion of the belt webbing which extends from a portion turned by the tongue body 30 to the end of the belt webbing acts as a lap belt 10A.

As the belt webbing 10 is in tension, the belt webbing 10 biases the locking plate 44 in a direction that the locking plate 44 is pushed against the tongue body 30 as indicated by an arrow B in FIG. 4. Therefore, the belt webbing 10 is strongly clamped between the locking plate 44 and the tongue body 30.

In this embodiment, as is apparent from FIG. 4, as long as the lap belt 10A is positioned at a tongue body 30 side than a line L extending rearwardly of the locking plate 44, the tensile force on the belt webbing 10 acts to strongly draw the locking plate 44 toward the tongue body 30. Moreover, the force caused by the belt webbing 10 which is applied to the locking plate 44 in the direction indicated by the arrow B is increased according to "the principle of lever" and acts as a clamping force between the locking plate 44 and the tongue body 30. As a result of this, the belt webbing 10 is quite strongly clamped between the locking plate 44 and the tongue body 30.

As an angle θ between the lap belt 10A and the line L becomes greater, the clamping force of the belt webbing 10 is increased. It should be noted that, even when the angle θ is 0°, the belt webbing 10 is enough strongly clamped between the locking plate 44 and the tongue body 30.

As mentioned above, since the belt webbing 10 is strongly clamped between the locking plate 44 and the tongue body 30, the tension on the lap belt 10A remains and the locking plate 44 is kept in its strongly biased state in the direction indicated by the arrow B even when the shoulder belt 10B is loose. Therefore, the lap belt 10A can keep holding the child restraining seat extremely securely in position on the vehicle seat because the large tension remains in the lap belt 10A even when the shoulder belt 10B is loose.

Figure 6:
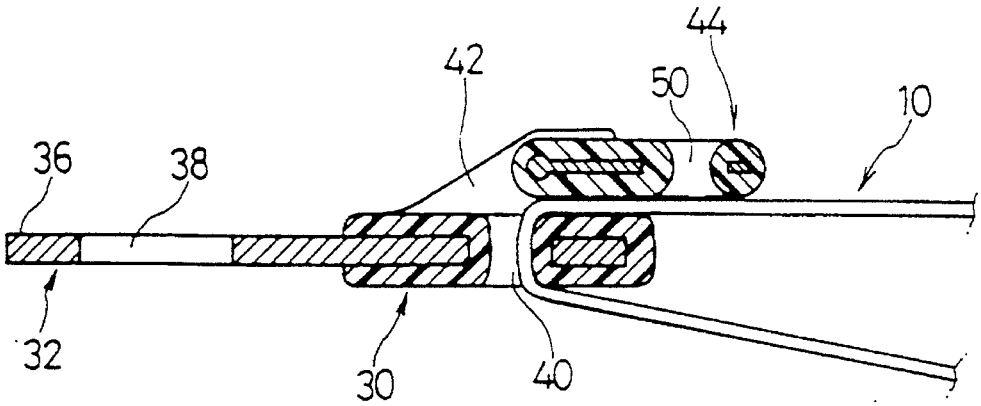
FIG. 6 is a sectional view of the tongue assembly of the first embodiment when the tongue assembly is used for restraining an occupant.
Figure 7:
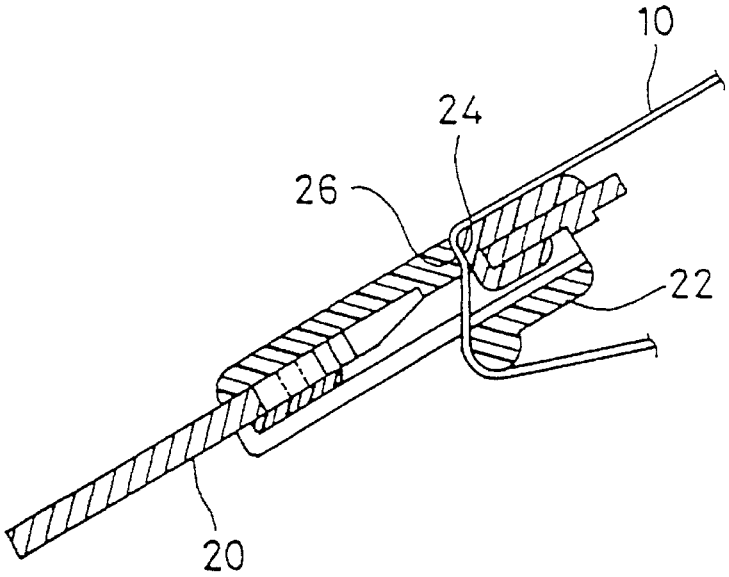
FIG. 7 PRIOR ART
FIG. 7 is a sectional view of a conventional tongue assembly.
Figure 8:
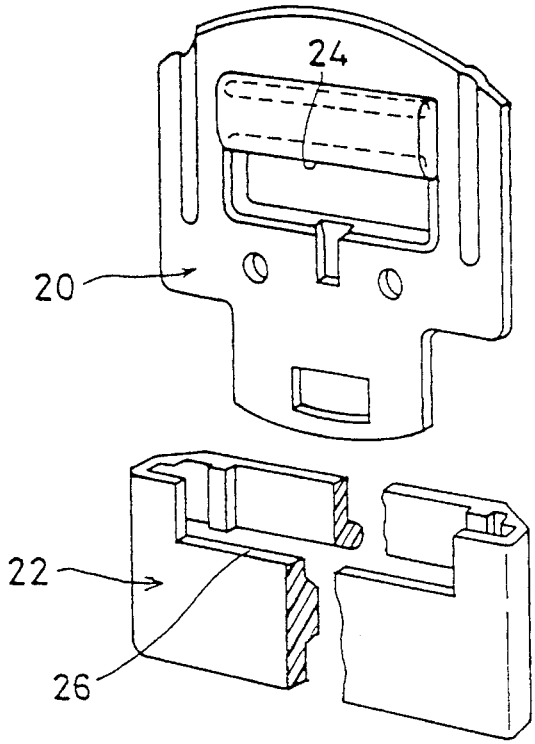
FIG. 8 is an exploded perspective view of the conventional tongue assembly.
Figure 9:
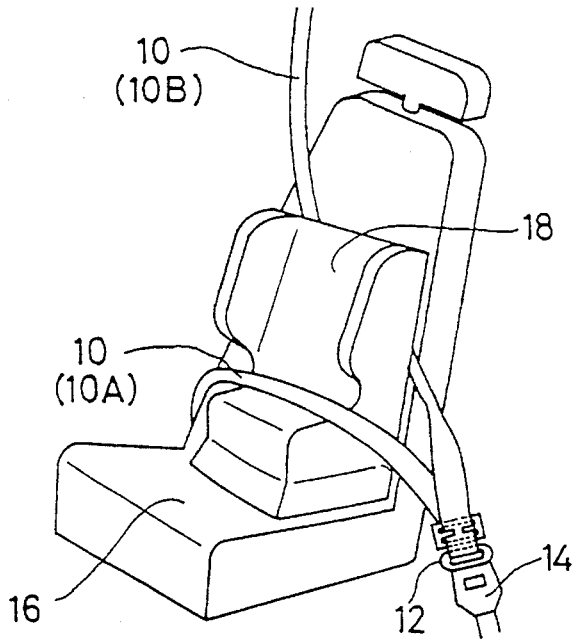
PRIOR ART FIG. 9
FIG. 9 is a perspective view showing a manner of restraining movement of a child restraining seat.

The tongue assembly of the first embodiment can be usually used for restraining the occupant when the belt webbing 10 is extended only through the first slit 40 as shown in FIG. 6. The belt webbing 10 can be easily threaded into and pulled out of the second slit 50 through the cutout 52. In FIG. 6, the belt webbing 10 is capable of smoothly traveling through the first slit 40 in the both directions so that the seat belt device using the tongue assembly is comfortable for the occupant.

Figure 10:
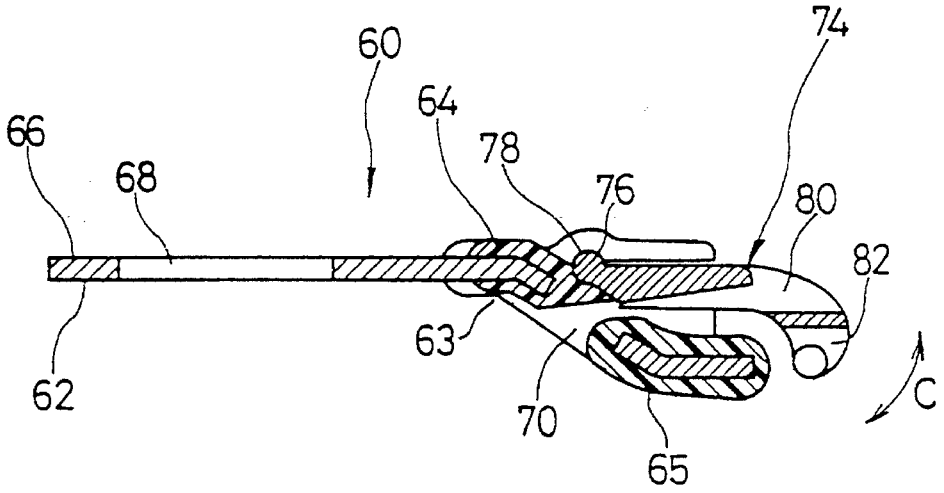
FIG. 10 is a longitudinal sectional view of a tongue assembly according to a second embodiment of the present invention.
Figure 11:
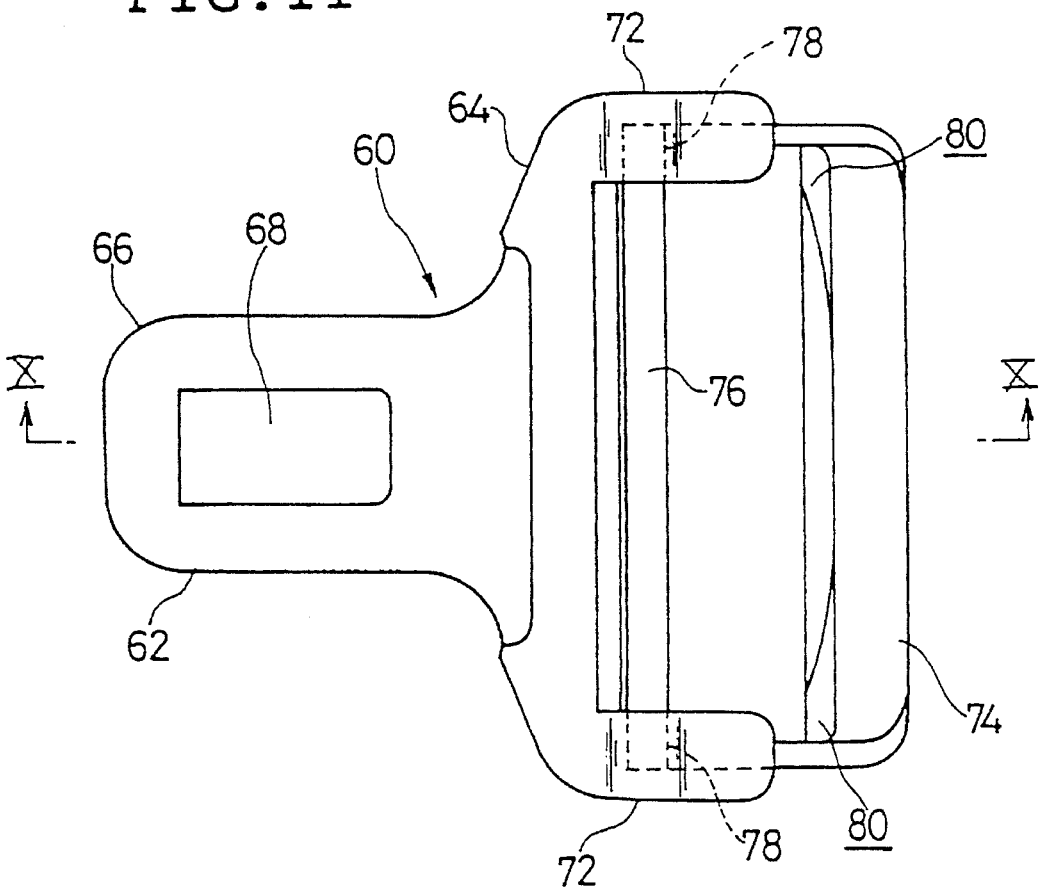
FIG. 11 is a top plan view of the tongue assembly according to the second embodiment.
Figure 12:
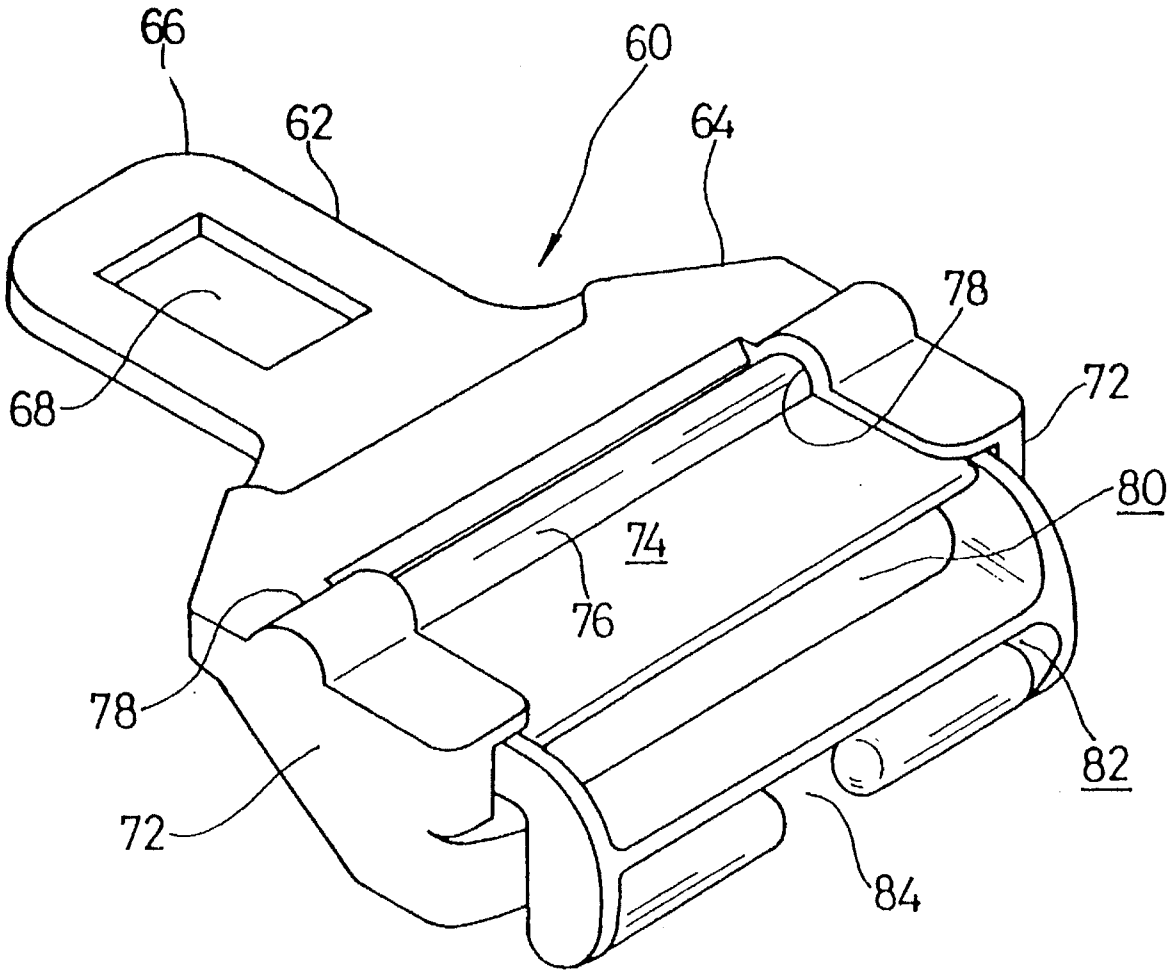
FIG. 12 is a perspective view of the tongue assembly according to the second embodiment.
Figure 13:
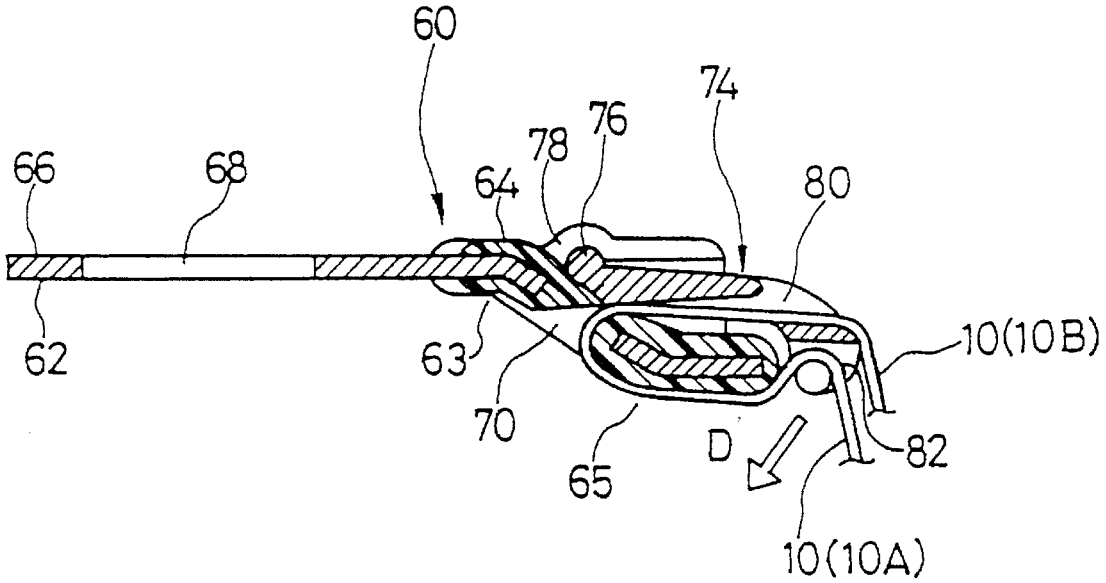
FIG. 13 is a sectional view of the tongue assembly of the second embodiment, with belt webbing extending therethrough.
Figure 14:
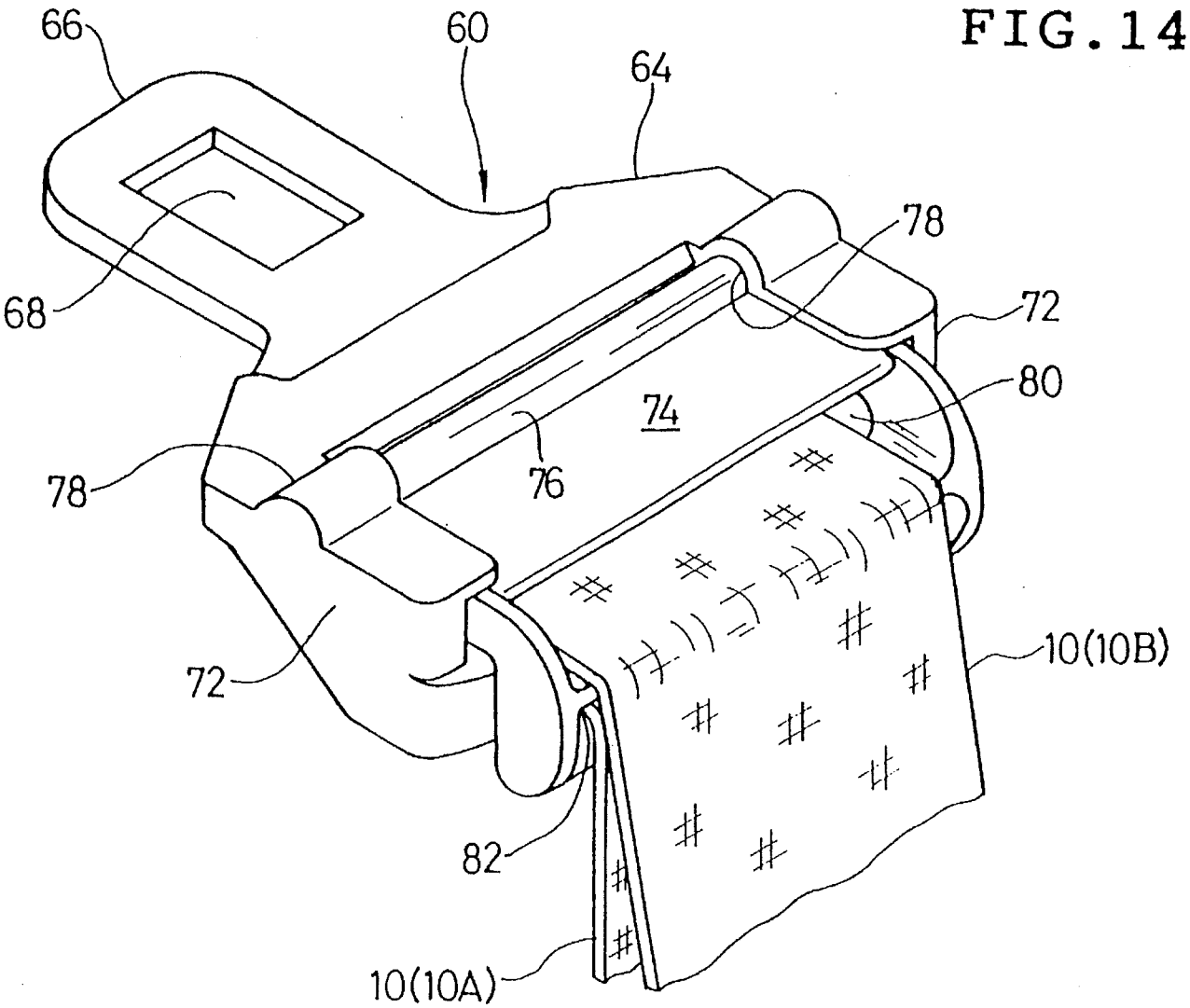
FIG. 14 is a perspective view of the tongue assembly of the second embodiment, with the belt webbing extending therethrough.

A second embodiment will now be described referring to FIGS. 10 through 15. FIG. 10 is a longitudinal sectional view showing a tongue assembly according to the second embodiment, FIG. 11 is a top plan view of the tongue assembly, FIG. 12 is a perspective view showing the tongue assembly, FIG. 13 is a sectional view showing a situation that belt webbing is extended through the tongue assembly to hold the child restraining seat, and FIG. 14 is a perspective view showing the same as shown in FIG. 13.

A numeral 60 designates a tongue body formed in a plate shape. The tongue body 60 comprises a metal plate 62 which is bent at two portions to be formed substantially in a S shape in a section and a synthetic resin member 64 stuck to the metal plate 62. The synthetic resin member 64 is molded as a unitary piece on the metal plate 62 by setting the metal plate 62 as an insert in a mold for the synthetic resin member 64 during molding the synthetic resin member 64.

The front end portion of the metal plate 62 is an insertion portion 66 to be inserted into a buckle (not shown). The insertion portion 66 is provided with an opening 68 for engaging with a latch plate of the buckle.

The tongue body 60 is provided with a first slit 70 extending laterally (in a direction vertical to the longitudinal direction of the tongue body 60) which is formed between a first bending portion 63 and a second bending portion 65 of the tongue body 60. The tongue body 60 has side walls 72 formed along the both side edges thereof.

A locking plate 74 is disposed to face a top surface of the tongue body 60. The locking plate 74 has a pin 76 fixed to the front edge thereof. The ends of the pin 76 fit into pin supporting portions 78 which have grooves extending from walls 72 toward the central portion of the tongue body 60. Therefore, the locking plate 74 is mounted to the tongue body 60 to allow pivotal movement along a direction indicated by an arrow C in FIG. 10 so that the rear end portion thereof freely leaves from or approaches the tongue body 60.

The locking plate 74 is provided with a second slit 80 extending laterally and disposed in a central portion thereof and is further provided with a third slit 82 extending laterally and disposed in a rear end portion thereof. The locking plate 74 is also provided with a cutout 84 extending from the rear edge of the locking plate 74 to the third slit 82. The belt webbing 10 can be easily threaded into and pulled out of the third slit 82 through the cutout 84.

A rear portion of the locking plate 74 further extends rearwardly than the position of the rear edge of the tongue body 60. Therefore, the third slit 82 extending in the rear end portion of the locking plate 74 is disposed at a more rearward and upward position than the rear edge of the tongue body 60.

For restraining movement of the child restraining seat by using the tongue assembly as structured above, as shown in FIG. 13, a shoulder belt 10B of the belt webbing 10 is extended from the second slit 80 to the first slit 70 through a path between the locking plate 74 and the tongue body 60 and is extended through the first slit 70. The belt webbing 10 is then turned back at the rear edge of the tongue body 60 to reach the third slit 82 and is extended through the third slit 82. A portion of the belt webbing which extends from a portion turned by the tongue body 60 to the proximal end of the belt webbing acts as a lap belt 10A.

As the belt webbing 10 is in tension, the belt webbing 10 biases the locking plate 74 in a direction that the locking plate 74 is pushed against the tongue body 60 as indicated by an arrow D in FIG. 13. Therefore, the belt webbing 10 is strongly clamped between the locking plate 74 and the tongue body 60.

Moreover, the force caused by the belt webbing 10 which is applied to the locking plate 74 in the direction indicated by the arrow D is increased according to the principle of lever and acts as a clamping force between the locking plate 74 and the tongue body 60. As a result of this, the belt webbing 10 is quite strongly clamped between the locking plate 74 and the tongue body 60.

Since the belt webbing 10 is strongly clamped between the locking plate 74 and the tongue body 60 as described above, the tension on the lap belt 10A remains and the locking plate 74 is kept in its strongly biased state in the direction indicated by the arrow D even when the shoulder belt 10B is loose. Therefore, the lap belt 10A can keep holding the child restraining seat extremely securely in position on the vehicle seat because the large tension remains in the lap belt portion 10A even when the shoulder belt 10B is loose.

Figure 15:
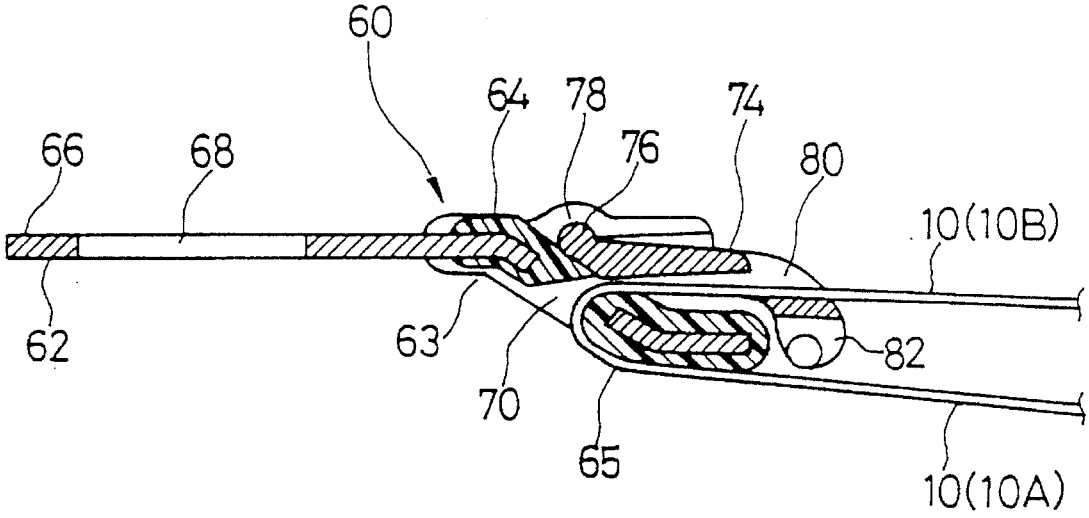
FIG. 15 is a sectional view of the tongue assembly of the second embodiment when the tongue assembly is used for restraining an occupant.

The tongue assembly of the second embodiment can be usually used for restraining the occupant when the belt webbing 10 is extended only through the first and second slits 70 and 80 as shown in FIG. 15. In FIG. 15, the belt webbing 10 is capable of smoothly traveling through the first slit 70 and the second slit 80 in the both directions so that the seat belt device using the tongue assembly is comfortable for the occupant.

As mentioned above, the tongue assembly for the seat belt device according to the present invention is capable of extremely tightly holding the child restraining seat in position on the vehicle seat and, furthermore, can keep restraining movement of the child restraining seat tightly by the lap belt even when the shoulder belt is loose.

The tongue assembly can be used for restraining the occupant when the belt webbing is extended only through the first slit. In this case, the seat belt device with the tongue assembly is comfortable for the occupant because the belt webbing is capable of smoothly traveling through the first slit.

The belt webbing is easily threaded into and pulled out of the second slit. Therefore, the tongue assembly can be easily used for restraining either the child restraining seat or the occupant.

What is claimed is:

1. A tongue assembly for a seat belt device with a belt webbing, comprising:

a tongue body having an elongated shape and including a first front end adapted to be inserted into a buckle, a first slit extending perpendicular to a longitudinal direction of the tongue body and situated away from the first front end, and a first rear portion situated between the first slit and a first rear edge of the tongue body, and a locking plate disposed above the tongue body, said locking plate including a second front end pivotally connected to the tongue body, a second slit extending substantially parallel to the first slit, a second front portion situated between the second front end and the second slit and located above the first rear portion of the tongue body, a second rear portion situated between the second slit and a second rear edge of the locking plate and disposed laterally away from the first rear edge, and a cutout located in the second rear portion, said belt webbing extending between the first rear portion and the second front portion and passing through the first slit so that when the belt webbing does pass the second slit, the tongue plate moves smoothly along the belt webbing, and when said belt webbing passes the second slit and is pulled, the belt webbing is frictionally held between the first rear portion and the second front portion to restrict movement of the tongue plate along the belt webbing.

2. A tongue assembly as claimed in claim 1, wherein said tongue body comprises a metal plate and a synthetic resin member covering a rear portion of said metal plate.

3. A tongue assembly as claimed in claim 3, wherein said tongue body has side walls formed along both side edges of the rear portion of said metal plate and both sides of the second front end of said locking plate are supported.

4. A tongue assembly as claimed in claim 3, wherein and outer surface of said locking plate is covered by synthetic resin.

5. A tongue assembly as claimed in claim 1, wherein said cutout is disposed at a central portion with regard to a width direction of said locking plate.

6. A tongue assembly as claimed in claim 1, wherein said belt webbing includes a lap belt and a shoulder belt, said lap belt passing though the second slit, extending outside the first rear portion, and passing through the first slit, between the first rear portion and the second front portion and through the second slit to become the should belt when the belt webbing is frictionally held.

7. A tongue assembly as claimed in claim 1, wherein said locking plate further includes an additional slit situated in the second front portion parallel to the second slit, said belt webbing passing through the additional slit.

8. A tongue assembly as claimed in claim 7, wherein said tongue body is curved so that the first slit and the additional slit align substantially linearly.

9. A tongue assembly as claimed in claim 8, wherein said belt webbing includes a lap belt and a shoulder belt, said lap belt passing though the second slit, extending outside the first rear portion, and passing through the first slit, between the first rear portion and the second front portion and through the additional slit to become the should belt when the belt webbing is frictionally held.

* * * * *